US009114629B2

(12) United States Patent
Toya

(10) Patent No.: US 9,114,629 B2
(45) Date of Patent: Aug. 25, 2015

(54) PRINTING APPARATUS

(71) Applicant: SEIKO EPSON CORPORATION, Tokyo (JP)

(72) Inventor: Akihiro Toya, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/222,438

(22) Filed: Mar. 21, 2014

(65) Prior Publication Data

US 2014/0292845 A1 Oct. 2, 2014

(30) Foreign Application Priority Data

Mar. 27, 2013 (JP) ..... 2013-065797

(51) Int. Cl.
*B41J 29/393* (2006.01)
*B41J 2/21* (2006.01)

(52) U.S. Cl.
CPC ..... *B41J 2/2114* (2013.01)

(58) Field of Classification Search
CPC ..... B41J 11/009; B41J 2/195; B41J 2/211; B41J 2/01; B41J 11/0015; B41J 2/04501; B41J 2/2114
See application file for complete search history.

(56) References Cited

U.S. PATENT DOCUMENTS 6,474,778 B1 * 11/2002 Koitabashi et al. ..... 347/43
8,469,484 B2 * 6/2013 Jogo et al. ..... 347/19

FOREIGN PATENT DOCUMENTS

JP 2002-307755 10/2002

* cited by examiner

*Primary Examiner* — Lamson Nguyen
(74) *Attorney, Agent, or Firm* — Workman Nydegger

(57) ABSTRACT

A printing apparatus includes a head and a control unit. The head discharges an imaging liquid for forming an image, and a supplementary liquid for supplementing the formation of the image with the imaging liquid onto a predetermined printing medium. The control unit is capable of selectively executing a first mode, in which the imaging liquid and the supplementary liquid are discharged from the head onto the predetermined printing medium, and a second mode, in which the imaging liquid is discharged from the head and the supplementary liquid is not discharged from the head.

9 Claims, 15 Drawing Sheets

PRINTING APPARATUS

BACKGROUND

1. Technical Field

The present invention relates to a printing apparatus.

2. Related Art

As the printing apparatus, an ink jet printer is known, which forms an image on a printing medium by discharging an ink from a head.

As an example of such an ink jet printer, there is a printer that performs printing using colored inks such as CMY and a non-colored transparent ink (clear ink).

JP-A-2002-307755 is an example of the related art.

Here, there is a case in which a film-based medium that is configured from polystyrene, polypropylene or the like is used as the printing medium. In regard to the film-based medium, there is a case in which a charge is generated on the medium surface due to friction and the like between the film-based medium and a paper feed roller, which is formed from a metal (aluminum, steel or the like), within the printer. The amount of charge is influenced by the state of the friction; therefore, there is variation on the medium surface.

When the ink is discharged onto the printing medium in which there is variation in the amount of charge, an ink mist (so-called satellites) which is generated together with the discharging accumulates in a region at which the amount of charge is great. As a result, there is a case in which hazy image degradation occurs in the printed object.

On the other hand, it is possible to reduce the amount of charge to be substantially uniform by applying a supplementary ink such as a clear ink to the entire printing medium in advance.

However, the amount of charge differs depending on the environment (for example, a difference in moisture). In other words, even when using the same film-based medium, the degree of influence received from satellites (the degree of image degradation) is not fixed. Therefore, even when using the film-based medium, there is a case in which it is not necessary to use the supplementary ink.

SUMMARY

An advantage of some aspects of the invention is to provide a printing apparatus that is capable of selecting whether or not to use a supplementary liquid when using a predetermined printing medium.

The main invention is a printing apparatus that includes a head and a control unit. The head discharges an imaging liquid for forming an image, and a supplementary liquid for supplementing the formation of the image with the imaging liquid onto a predetermined printing medium. The control unit is capable of selectively executing a first mode, in which the imaging liquid and the supplementary liquid are discharged from the head onto the predetermined printing medium, and a second mode, in which the imaging liquid is discharged from the head and the supplementary liquid is not discharged from the head.

Other features of the invention will be made clear by the description of the specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Outline of Disclosure

Figure 1:
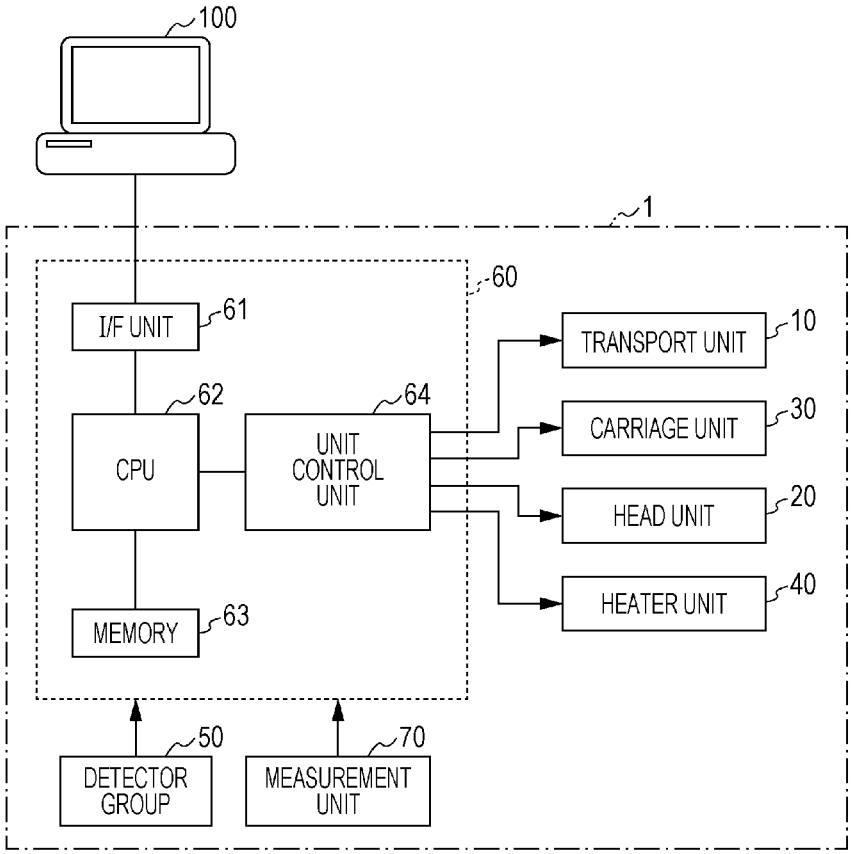
FIG. 1 is a diagram showing the configuration of a printing apparatus according to an embodiment.

At least the following will be made clear by the description of the specification and the accompanying drawings.

According to an aspect of the invention, there is provided a printing apparatus, including a head which discharges an imaging liquid for forming an image, and a supplementary liquid for supplementing formation of the image with the imaging liquid on a predetermined printing medium; and a control unit which is capable of selectively executing a first mode, in which the imaging liquid and the supplementary liquid are discharged from the head onto the predetermined printing medium, and a second mode, in which the imaging liquid is discharged from the head, and the supplementary liquid is not discharged from the head.

The printing apparatus is capable of selecting whether or not to use the supplementary liquid when using the predetermined printing medium.

The control unit may be capable of selectively executing a third mode, which is a mode in which the imaging liquid and the supplementary liquid are discharged from the head onto the predetermined printing medium, and in which the discharge amount of the supplementary liquid is greater than in the first mode.

The printing apparatus is capable of selecting the discharge amount of the supplementary liquid when using the predetermined printing medium.

The printing apparatus may further include a measurement unit which measures a moisture of the printing medium, and, when a measurement result obtained by the measurement unit is a predetermined threshold value or less, the control unit may control the head to increase the discharge amount of the supplementary liquid in the first mode.

The printing apparatus is capable of increasing the discharge amount of the supplementary liquid when the moisture is low.

When the first mode is selected, the control unit may control the head to execute the discharge of the imaging liquid and the discharge of the supplementary liquid in different passes.

When the first mode is selected, the control unit may control the head to execute the discharge of the imaging liquid and the discharge of the supplementary liquid in a same pass.

When the first mode is selected, the control unit may control the head to execute the discharge of the supplementary liquid in relation to a region of the printing medium that contains a region on which the image is formed.

When the first mode is selected, the control unit may control the head to execute the discharge of the supplementary liquid in relation to a region of the printing medium onto which the imaging liquid is not discharged.

According to the printing apparatuses described above, when the first mode is selected, it is possible to adjust the timings at which the imaging liquid and the supplementary liquid are discharged, or the regions onto which discharging is performed.

Furthermore, when a region, which is peeled off after the image is formed, is present in a region of the printing medium, and the first mode is selected, the control unit may control the head to not execute the discharge of the supplementary liquid in relation to the peel-off region.

The printing apparatus is capable of selectively causing the ink mist to accumulate on the peel-off region.

Configuration of Printing Apparatus

Figure 2:
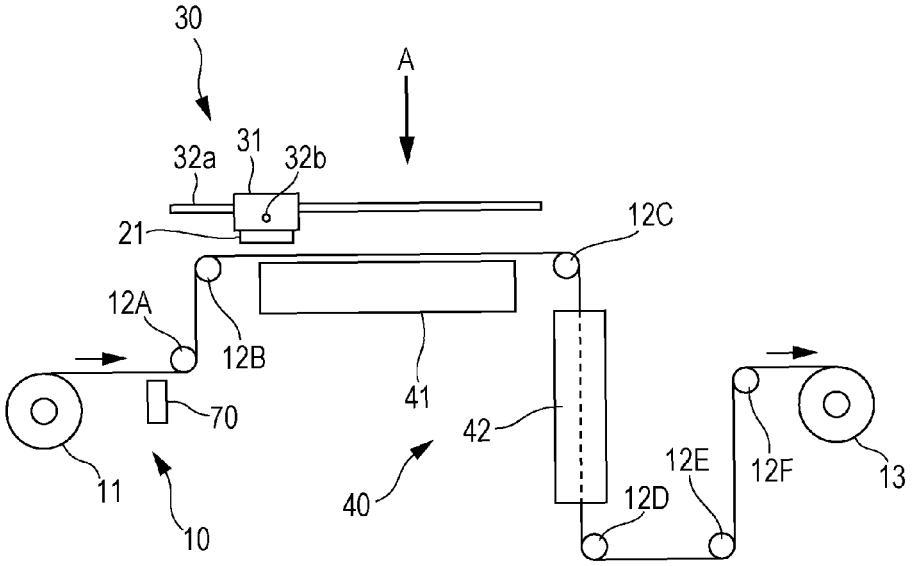
FIG. 2 is a diagram showing the configuration of the printing apparatus according to the embodiment.
Figure 3:
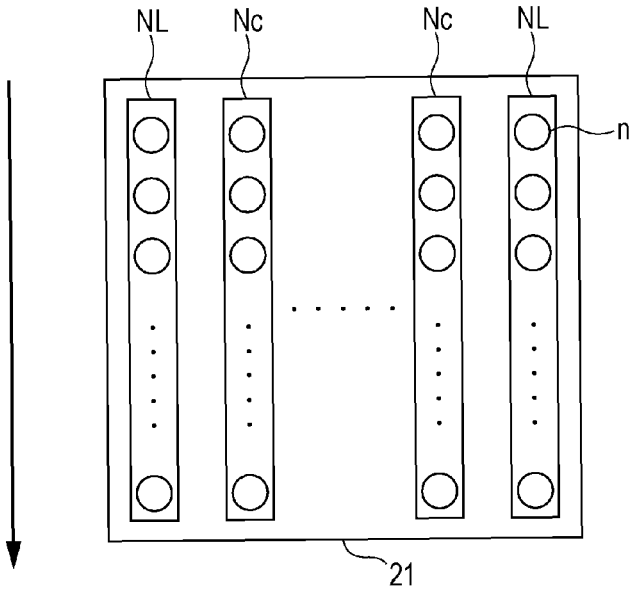
FIG. 3 is a diagram showing the configuration of the printing apparatus according to the embodiment.
Figure 4:
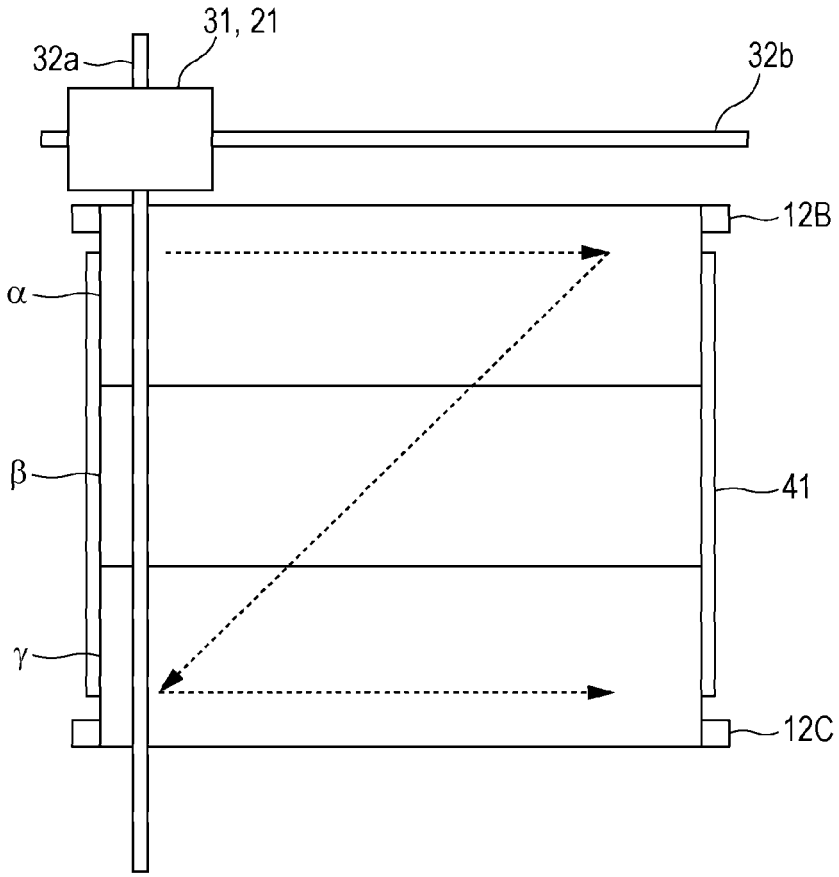
FIG. 4 is a diagram showing the configuration of the printing apparatus according to the embodiment.
Figure 5A:
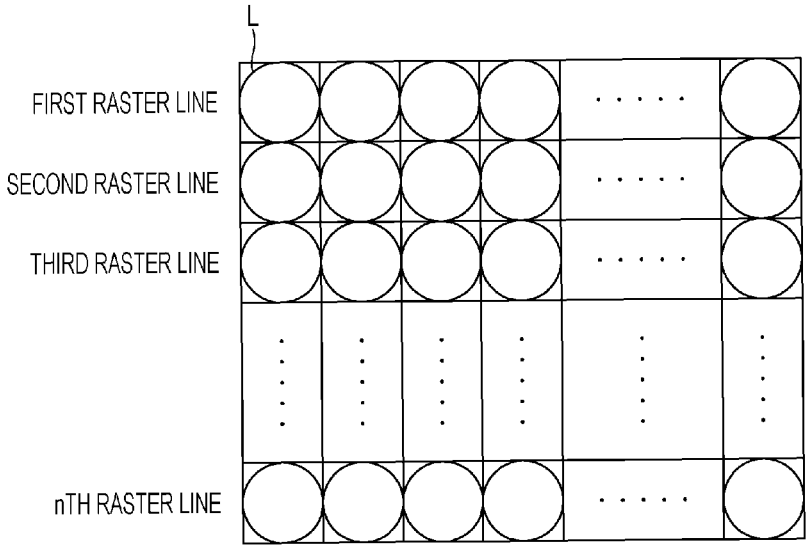
FIG. 5A is a diagram showing a first pattern of the discharge operations of a supplementary liquid and an imaging liquid according to the embodiment.
Figure 5B:
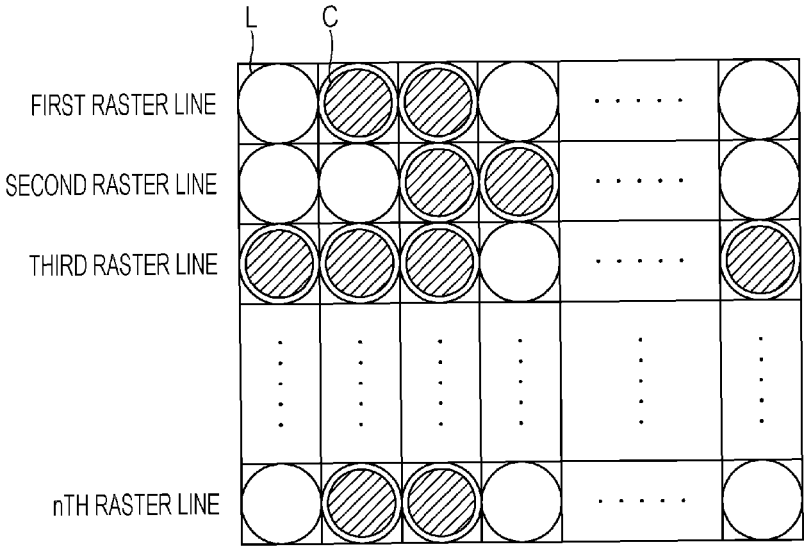
FIG. 5B is a diagram showing the first pattern of the discharge operations of the supplementary liquid and the imaging liquid according to the embodiment.

Description will be given of a configuration of the printing apparatus according to this embodiment with reference to FIGS. 1 to 4. In this embodiment, a lateral system (described hereinafter) ink jet printer 1 is exemplified as the printing apparatus. FIG. 1 is a block diagram showing the overall configuration of an ink jet printer 1. FIG. 2 is a schematic diagram showing the configuration of a portion of the ink jet printer 1. FIG. 3 is a diagram showing an example of a head 21 (described hereinafter). FIG. 4 is a diagram showing the printing medium when viewed from the A direction in FIG. 2. In FIG. 4, a portion of the configuration shown in FIG. 2 is omitted.

The ink jet printer 1 includes a transport unit 10, a head unit 20, a carriage unit 30, a heater unit 40, a detector group 50, a controller 60, and a measurement unit 70. The ink jet printer 1 that receives the image data for printing from a computer 100, which is an external apparatus, controls each unit (the transport unit 10, the head unit 20, the carriage unit 30, and the heater unit 40) using the controller 60. The controller 60 controls each unit on the basis of the image data received from the computer 100 to form (print) an image on the printing medium. The situation within the ink jet printer 1 is monitored by the detector group 50. The detector group 50 outputs the detection results to the controller 60. The controller 60 controls each unit on the basis of the detection results that are output from the detector group 50.

The transport unit 10 transports a roll-shaped printing medium in a predetermined direction (hereinafter, the direction in which the printing medium is transported is sometimes referred to as the "transport direction"). In this embodiment, description will be given using a film-based medium as an example of the printing medium. The film-based medium is an example of the "predetermined printing medium".

As shown in FIG. 2, the transport unit 10 includes a supply mechanism 11, transport rollers 12A to 12F, and a winding mechanism 13. The supply mechanism 11 is a mechanism that feeds the printing medium to the carriage unit 30 (the head unit 20) side. The transport rollers 12A to 12F transport the printing medium, which is fed from the supply mechanism 11, to a position (hereinafter sometimes referred to as the "printing position") at which an image is formed (printed). The transport rollers 12A to 12F transport the printing medium, which has an image formed thereon at the printing position, to the winding mechanism 13. The winding mechanism 13 is a mechanism that winds the printing medium on which an image is formed. Note that, in the ink jet printer 1, there is a case in which the supply mechanism 11 side is referred to as the "upstream side", and the winding mechanism 13 side is referred to as the "downstream side".

The head unit 20 includes a head 21. The head 21 in this embodiment discharges the imaging liquid and the supplementary liquid onto the printing medium.

The imaging liquid is a liquid (for example, a colored ink such as cyan, magenta and yellow) for forming an image on the printing medium. The supplementary liquid is a liquid (for example, a clear ink, or a white ink) for supplementing the formation of the image with the imaging liquid. It is desirable that the supplementary liquid be a liquid that does not change the surface quality of the printing medium.

The image is formed on the printing medium by discharging the imaging liquid from nozzles n (described hereinafter)

of the head 21. A layer of the supplementary liquid is formed on the printing medium by discharging the supplementary liquid from the nozzles n (described hereinafter) of the head 21.

FIG. 3 is a schematic diagram showing a surface of the head 21 that opposes the printing medium. The arrow in FIG. 3 shows the transport direction. As shown in FIG. 3, a plurality of nozzle rows are formed such that the nozzles thereof line up in the transport direction on the head 21 in this embodiment. Specifically, in the head 21, a plurality of nozzle rows Nc that discharge a colored ink, which is the imaging liquid, are provided in a direction perpendicular to the transport direction. The same color of colored ink is discharged from one nozzle row. One row of nozzle rows NL that discharge a clear ink, which is the supplementary liquid, is provided for each of the nozzle rows Nc so as to interpose the nozzle rows Nc. Each nozzle row is configured by a plurality of the nozzles n. The liquid that corresponds to one dot is discharged from one of the nozzles n.

The carriage unit 30 causes the head unit 20 (the head 21) to move in a predetermined direction. As shown in FIGS. 2 and 4, the carriage unit 30 in this embodiment includes a carriage 31, a guide 32*a*, and a guide 32*b*. The head unit 20 is mounted on the carriage 31. The guide 32*a* is a member for guiding the movement of the carriage 31 in the transport direction. The guide 32*b* is a member for guiding the movement of the carriage 31 in a direction that is perpendicular to the transport direction. Using the guide 32*a* and the guide 32*b*, it is possible to move the carriage 31, on which the head unit 20 is mounted, two dimensionally in respect to the printing medium that is in a printing position. Hereinafter, the direction in which the carriage unit 30 (the head unit 20) moves is sometimes referred to as the "movement direction". The broken line arrows shown in FIG. 4 are an example showing the movement of the carriage unit 30 (the head unit 20).

In this manner, a system in which, by moving the head unit 20 two dimensionally (or, alternatively, one dimensionally) in relation to the printing medium and discharging a liquid, formation of the image is performed without transporting the printing medium is referred to as a "lateral system". When performing formation of the image using the lateral system, at the point in time at which the printing medium is transported, an image that is based on the image data is completed on the printing medium at the printing position.

The heater unit 40 includes a hot platen 41 and a drying mechanism 42. The hot platen 41 is a member that supports the printing medium in the printing position. A heater is built into the hot platen 41, and drying of the liquid (the ink), which forms an image or a layer of a supplementary liquid formed on the printing medium, is carried out by heating the printing medium in the printing position. The drying mechanism 42 is provided closer to the downstream side than the printing position, and the drying of the liquid (the ink) that forms the image or the layer of the supplementary liquid outside of the printing position is promoted by heating the printing medium, on which the image is formed.

The detector group 50 is configured to contain a sensor (not shown) that detects the transportation amount of the printing medium performed by the transport unit 10, an encoder for detecting the rotation amount of a transport roller (not shown) that transports the printing medium, and a linear encoder for detecting the position of the carriage 31 in the movement direction.

The controller 60 is a control unit for performing control of the ink jet printer 1. The controller 60 includes an interface (I/F) unit 61, a CPU 62, memory 63 and a unit control circuit 64.

The interface unit 61 performs transmission and receiving of data between the computer 100 and the ink jet printer 1. The CPU 62 is a computational processing apparatus for performing control of the entire ink jet printer 1. The memory 63 is for securing a region that stores programs, or an operation region of the CPU 62. The memory 63 stores the image data, which is the printing target. The CPU 62 controls each unit via the unit control circuit 64 in accordance with the programs stored in the memory 63, and causes the units to execute various processes.

For example, as shown in FIG. 4, the CPU 62 causes the head 21 to move (refer to the broken line arrows of FIG. 4) two dimensionally in accordance with the image data stored in the memory 63 via the unit control circuit 64. In this manner, the ink jet printer 1 forms an image and a layer of the supplementary liquid on each of the printing regions (a print region a to a print region y) of the printing medium in the printing position (detailed hereinafter). The term "printing regions" refers to regions onto which the imaging liquid and the supplementary liquid are discharged (the regions onto which the image and the layer of the supplementary liquid are formed). In this embodiment, the printing regions correspond to the entire printing medium in the printing position.

The measurement unit 70 measures the moisture of the printing medium. The measurement unit 70 is provided within the ink jet printer 1, for example, in the proximity of the printing medium (refer to FIG. 2). The measurement unit 70 in this embodiment is an example of the "measurement unit".

The phrase "measure the moisture of the printing medium" includes both directly measuring the moisture of the printing medium itself, and estimating the moisture of the printing medium by measuring the moisture of the atmosphere of the periphery of the printing medium or the like. Therefore, the measurement unit 70 may be a means of directly measuring the moisture of the printing medium itself, and may also be a means of estimating the moisture of the printing medium by measuring the moisture of the atmosphere of the periphery of the printing medium.

In the later case, the means (the measurement unit 70) of estimating the moisture of the printing medium may also be a means of estimating the moisture of the printing medium itself on the basis of a moisture data table (stored in the memory 63 or the like) that shows the correlation between the actually measured moisture of the atmosphere of the periphery of the printing medium, the pre-measured moisture of the atmosphere of the periphery of the printing medium, and the moisture of the printing medium itself. Furthermore, the measurement unit 70 may also be configured to estimate, of the atmosphere of the periphery of the printing medium, the atmosphere of the upstream side of the printing position onto which the imaging liquid is discharged in the transport path of the printing medium, in particular.

Modes of Discharging Liquids

For example, when transporting the film-based medium using the transport unit 10, friction is generated between the transport rollers 12A and 12B, the hot platen 41, and the film-based medium. As a result, when the film-based medium reaches the printing position, a charge is generated on the medium surface. Since the amount of charge of the medium surface changes according to the state of the friction, in general, fluctuation occurs in the amount of charge of the medium surface.

Accordingly, in order to equalize the amount of charge across the medium surface, it is desirable that the supplementary liquid be applied thereto.

On the other hand, the amount of charge of the printing medium differs depending on the environment. For example, when there is a lot of moisture, a charge is not easily generated on the medium surface, and there is a likelihood that the amount of charge is reduced. In this case, even the film-based medium is not easily influenced by the satellites.

Therefore, the controller 60 (the control unit) in this embodiment is capable of selectively executing different modes (a first mode, and a second mode) for forming an image on a predetermined printing medium (for example, the film-based medium).

The first mode is a mode in which the imaging liquid and the supplementary liquid are discharged from the head 21 onto the predetermined printing medium. The second mode is a mode in which the imaging liquid is discharged from the head 21 onto the predetermined printing medium, and the supplementary liquid is not discharged from the head 21.

It is possible to perform the selection of the modes automatically or manually.

In the case of automatic selection, for example, the controller 60 compares the value (%) of moisture that is measured by the measurement unit 70 with a condition that is set in advance (for example, a moisture of 30%). When the measured moisture is less than the condition that is set in advance (that is, when in a state in which a charge is easily generated), the controller 60 selects and executes the first mode that is set in advance in relation to the predetermined printing medium.

In contrast, when the measured moisture is higher than the condition that is set in advance (that is, when in a state in which a charge is not easily generated), the controller 60 selects and executes the second mode that is set in advance in relation to the predetermined printing medium. The first mode and the second mode are stored in the memory 63 or the like in a state of being associated with the predetermined printing medium. Furthermore, in each of the modes, the discharge amount of the liquids and the like is stored in advance.

On the other hand, for example, in the case of manual selection, the operator of the ink jet printer 1, confirms the value indicated by an indoor hygrometer. When the value indicated by the hygrometer is low (for example, 30% moisture), the operator can determine that there is a likelihood that a charge will be generated on the printing medium. In this case, the operator selects the first mode from the plurality of modes that are set in advance (the first mode, and the second mode), via an input unit (not shown) of the ink jet printer 1. The controller 60 executes the selected first mode.

In contrast, when the value indicated by the hygrometer is high (for example, 80% moisture), the operator can determine that there is a low likelihood that a charge will be generated on the printing medium. In this case, the operator selects the second mode via the input unit (not shown) or the like of the ink jet printer 1. The controller 60 executes the selected second mode.

Note that, in the case of manual selection, the operator may set the first mode and the second mode on each occasion. In this case, the controller 60 executes the set mode.

It is possible to reduce the variation in the amount of charge by setting the discharge amount of the supplementary liquid in the first mode to approximately 20% or more when the discharge amount of the imaging liquid of a single color is 100%.

Discharge Operation of Liquid

Description will be given of the discharge operations of the liquids in the first mode and the second mode with reference to FIGS. 5A to 11. FIGS. 5A to 11 are diagrams that schematically show the printing medium in the printing position. The image on the printing medium (the layer of the supplementary liquid L) is configured by a plurality of raster lines. A raster line is a row of dots lined up in a direction that is perpendicular to the transport direction of the printing medium. In this embodiment, the "nth raster line" refers to the raster line in the nth position. The term "pass" refers to the operation of forming dots by discharging a liquid from the moving head 21 (the nozzle n). In an example in which the imaging liquid C and the supplementary liquid L are discharged onto the same region, such as FIG. 5B, the dots of the imaging liquid C are shown smaller than the dots of the supplementary liquid L, such that the overlapping of the imaging liquid C and the supplementary liquid L is clear. The dots of the imaging liquid C and the dots of the supplementary liquid L may be of the same size, and the dots of the supplementary liquid L may be smaller than the dots of the imaging liquid C.

Discharge Operations of Liquids in First Mode

In this embodiment, in the first mode, there are four patterns of the discharge operations of the imaging liquid C and the supplementary liquid L performed by the head 21. Which of the patterns to use when performing the discharge operations is, for example, set in advance for each of the ink jet printers 1. Alternatively, a plurality of patterns may be stored in the memory 63 or the like, and the operator may set an arbitrary pattern each time printing is performed.

First Pattern

In the first pattern, the controller 60 controls the head 21 to execute the discharging of the imaging liquid C and the discharging of the supplementary liquid L in different passes, and to execute the discharging of the supplementary liquid L onto a region of the printing medium that contains the regions on which the image is formed.

According to this method, a layer of the supplementary liquid L is formed on the region of the printing medium in the printing position, and the image is formed thereon.

As a specific example, first, the head 21 moves from an initial position (for example, the upper left of the printing medium shown in FIG. 5A) two dimensionally in relation to the printing medium, and discharges the supplementary liquid L onto the region of the printing medium in the printing position. In this case, dots of the supplementary liquid L are formed on all of the raster lines (first to nth, refer to FIG. 5A).

Next, the head 21 moves again from the initial position two dimensionally in relation to the printing medium, and discharges the imaging liquid C onto the region on which the image is formed. In this case, dots of the imaging liquid C are formed on the region on which the image is formed (refer to FIG. 5B). It is possible to determine the region on which the image is formed on the basis of the image data.

In this manner, it is possible to equalize the amount of charge on the surface of the printing medium by forming a layer by discharging the supplementary liquid L onto a region of the printing medium that contains the region on which the image is formed before discharging the imaging liquid C. Accordingly, it is possible to reduce the influence of satellites.

Note that there is also a different method for the first pattern. For example, the head 21 discharges the supplementary liquid L onto a region that corresponds to the first raster line in the first pass (refer to FIG. 6A). In this case, in the first raster line, a layer of the supplementary liquid L is formed. Next, the head 21 discharges the imaging liquid C onto a region that corresponds to the first raster line and is a region on which the image is formed, in the second pass (refer to FIG. 6B). In the same manner, the head 21 discharges the supplementary liquid L onto a region that corresponds to the nth raster line in the second n−1 pass (refer to FIG. 6C), and discharges the imaging liquid C onto a region that corresponds to the nth raster line and is a region on which the image is formed, in the second n pass (refer to FIG. 6D).

Second Pattern

In the second pattern, the controller 60 controls the head 21 to execute the discharging of the imaging liquid C and the discharging of the supplementary liquid L in different passes, and to execute the discharging of the supplementary liquid L onto a region of the printing medium onto which the imaging liquid C is not discharged.

According to this method, of the regions of the printing medium at the printing position, a layer of the supplementary liquid L is formed only on the regions of the printing medium on which the imaging liquid C is not discharged (the regions on which the image is not formed).

As a specific example, first, the head 21 moves from the initial position (for example, the upper left of the printing medium shown in FIG. 7A) two dimensionally in relation to the printing medium, and discharges the supplementary liquid L onto the region on which the image is not formed. In this case, in regard to the printing medium in the printing position, dots of the supplementary liquid L are formed on the region on which the image is not formed (refer to FIG. 7A).

Next, the head 21 moves again from the initial position two dimensionally in relation to the printing medium, and discharges the imaging liquid C onto the region on which the image is formed. In this case, dots of the imaging liquid C are formed on the region on which the image is formed (refer to FIG. 7B).

In this manner, it is possible to form a layer of the supplementary liquid L efficiently on the printing medium by discharging the supplementary liquid L only onto the regions on which the image is not formed. It is possible to equalize the amount of charge on the surface of the printing medium to some extent by forming a layer by discharging the supplementary liquid L before discharging the imaging liquid C. Accordingly, it is possible to reduce the influence of satellites.

Note that there is also a different method for the second pattern. For example, the head 21 discharges the supplementary liquid L onto a region that corresponds to the first raster line and is a region on which the image is not formed, in the first pass (refer to FIG. 8A). In this case, in the first raster line, a layer of the supplementary liquid L is formed on the region on which the image is not formed. Next, the head 21 discharges the imaging liquid C onto a region that corresponds to the first raster line and is a region on which the image is formed, in the second pass (refer to FIG. 8B). In the same manner, the head 21 discharges the supplementary liquid L onto a region that corresponds to the nth raster line and is the region on which the image is not formed, in the second n−1 pass (refer to FIG. 8C), and discharges the imaging liquid C onto a region that corresponds to the nth raster line and is a region on which the image is formed, in the second n pass (refer to FIG. 8D).

Third Pattern

In the third pattern, the controller 60 controls the head 21 to execute the discharging of the imaging liquid C and the discharging of the supplementary liquid L in the same pass, and to execute the discharging of the supplementary liquid L onto a region of the printing medium that contains the region on which the image is formed.

According to this method, in the same manner as in the first pattern, a layer of the supplementary liquid L is formed on the region of the printing medium in the printing position, and the image is formed thereon.

First, the head 21 discharges the supplementary liquid L onto a region that corresponds to the first raster line in the first pass. At this time, the head 21 discharges the imaging liquid C onto a region that corresponds to the first raster line and is a region on which the image is formed, in the same pass (the first pass, refer to FIG. 9A). In other words, at the point in time at which the first pass is complete, the imaging liquid C is discharged onto the layer of the supplementary liquid L on the first raster line.

Next, the head 21 discharges the supplementary liquid L onto a region that corresponds to the second raster line in the second pass. At this time, the head 21 discharges the imaging liquid C onto a region that corresponds to the second raster line and is a region on which the image is formed, in the same pass (the second pass, refer to FIG. 9B). In other words, at the point in time at which the second pass is complete, the imaging liquid C is discharged onto the layer of the supplementary liquid L on the second raster line.

In the same manner, the head 21 discharges the supplementary liquid L onto a region that corresponds to the nth raster line in the nth pass. At this time, the head 21 discharges the imaging liquid C onto a region that corresponds to the nth raster line and is a region on which the image is formed, in the same pass (the nth pass, refer to FIG. 9C). In other words, at the point in time at which the nth pass is complete, the imaging liquid C is discharged onto the layer of the supplementary liquid L on the nth raster line.

In this manner, it is possible to efficiently create a printed object by discharging the imaging liquid C and the supplementary liquid L in the same pass. It is also possible to equalize the amount of charge on the surface of the printing medium by forming a layer of the supplementary liquid L on a region of the printing medium that contains the region on which the image is formed. Accordingly, it is possible to reduce the influence of satellites.

Fourth Pattern

In the fourth pattern, the controller 60 controls the head 21 to execute the discharging of the imaging liquid C and the discharging of the supplementary liquid L in the same pass, and to execute the discharging of the supplementary liquid L onto a region of the printing medium onto which the imaging liquid C is not discharged.

According to this method, in the same manner as in the second pattern, of the regions of the printing medium in the printing position, a layer of the supplementary liquid L is formed only on the regions of the printing medium onto which the imaging liquid C is not discharged (the regions on which the image is not formed).

First, the head 21 discharges the supplementary liquid L onto a region that corresponds to the first raster line and is a region on which the image is not formed, in the first pass. At this time, the head 21 discharges the imaging liquid C onto a region that corresponds to the first raster line and is a region on which the image is formed, in the same pass (the first pass, refer to FIG. 10A). In other words, at the point in time at which the first pass is complete, the imaging liquid C and the supplementary liquid L are discharged onto the first raster line. However, in contrast to the third pattern, a layer of the supplementary liquid L is not formed on the region onto which the imaging liquid is discharged (the region on which the image is formed).

Next, the head 21 discharges the supplementary liquid L onto a region that corresponds to the second raster line and is a region on which the image is not formed, in the second pass. At this time, the head 21 discharges the imaging liquid C onto a region that corresponds to the second raster line and is a region on which the image is formed, in the same pass (the second pass, refer to FIG. 10B). In other words, at the point in time at which the second pass is complete, the imaging liquid C and the supplementary liquid L are discharged onto the second raster line.

In the same manner, the head 21 discharges the supplementary liquid L onto a region that corresponds to the nth raster line and is a region on which the image is not formed, in the nth pass. At this time, the head 21 discharges the imaging liquid C onto a region that corresponds to the nth raster line and is a region on which the image is formed, in the same pass (the nth pass, refer to FIG. 10C). In other words, at the point in time at which the nth pass is complete, the imaging liquid C and the supplementary liquid L are discharged onto the nth raster line.

In this manner, it is possible to efficiently create a printed object by discharging the imaging liquid C and the supplementary liquid L in the same pass. It is possible to form a layer of the supplementary liquid L efficiently on the printing medium by discharging the supplementary liquid L only onto the regions on which the image is not formed.

Other

Note that, in order to facilitate the description, in FIGS. 6A to 6D and 8A to 10C, description is given of an example in which the supplementary liquid L (the imaging liquid C) is discharged onto a region that corresponds to one raster line in one pass. On the other hand, for example, when using the head 21 in which there is a plurality of the nozzles n as shown in FIG. 3, it is also possible to simultaneously discharge the supplementary liquid L (the imaging liquid C) onto a region that corresponds to a plurality of raster lines in one pass.

Figure 6A:
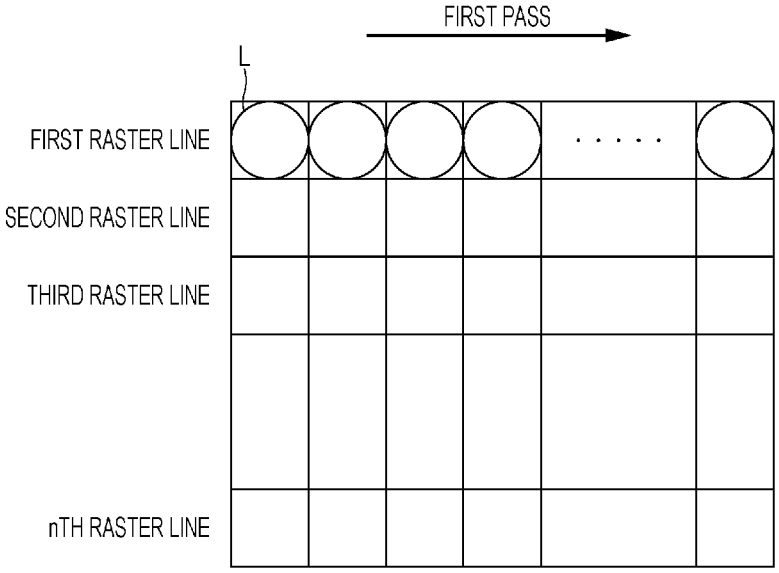
FIG. 6A is a diagram showing another example of the first pattern of the discharge operations of the supplementary liquid and the imaging liquid according to the embodiment.
Figure 6B:
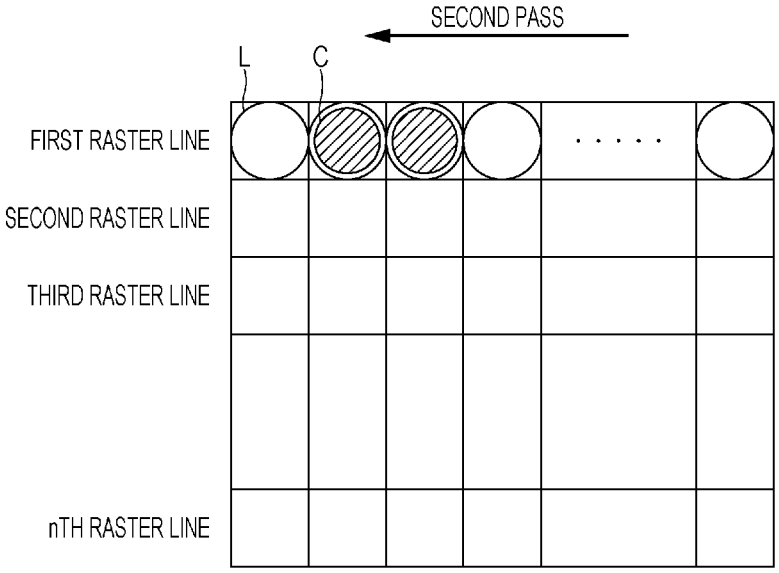
FIG. 6B is a diagram showing another example of the first pattern of the discharge operations of the supplementary liquid and the imaging liquid according to the embodiment.
Figure 6C:
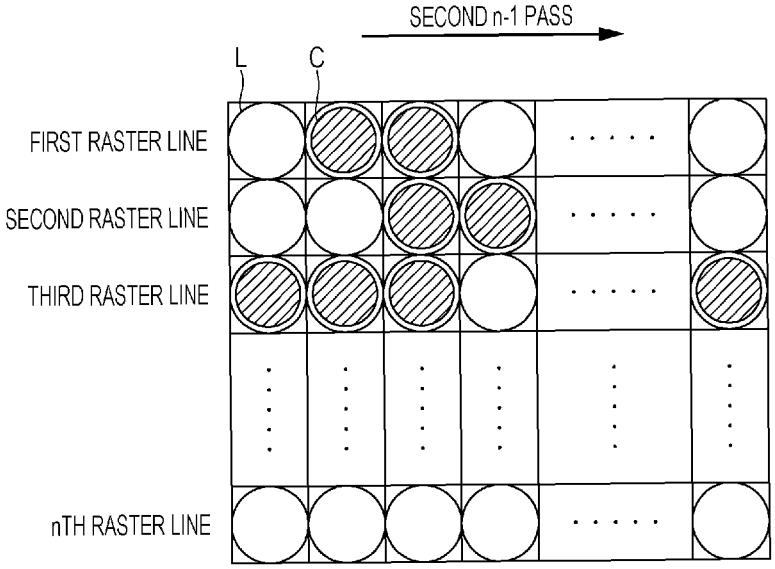
FIG. 6C is a diagram showing another example of the first pattern of the discharge operations of the supplementary liquid and the imaging liquid according to the embodiment.
Figure 6D:
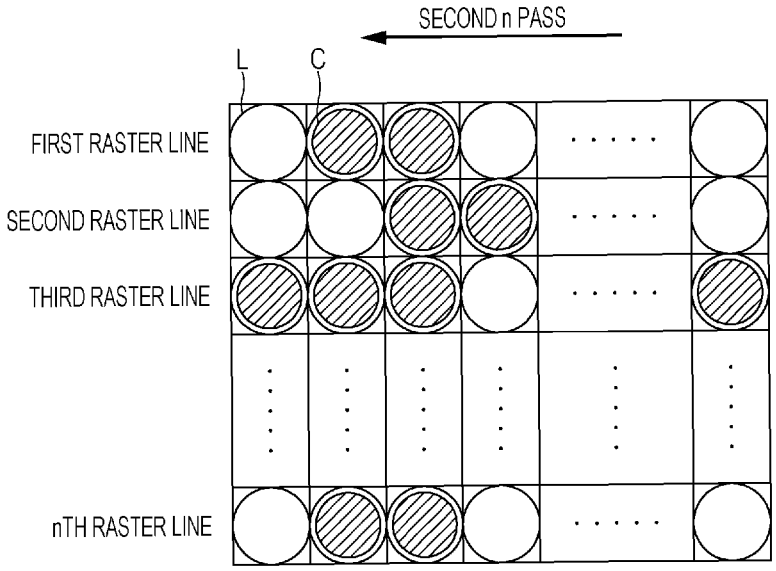
FIG. 6D is a diagram showing another example of the first pattern of the discharge operations of the supplementary liquid and the imaging liquid according to the embodiment.
Figure 7A:
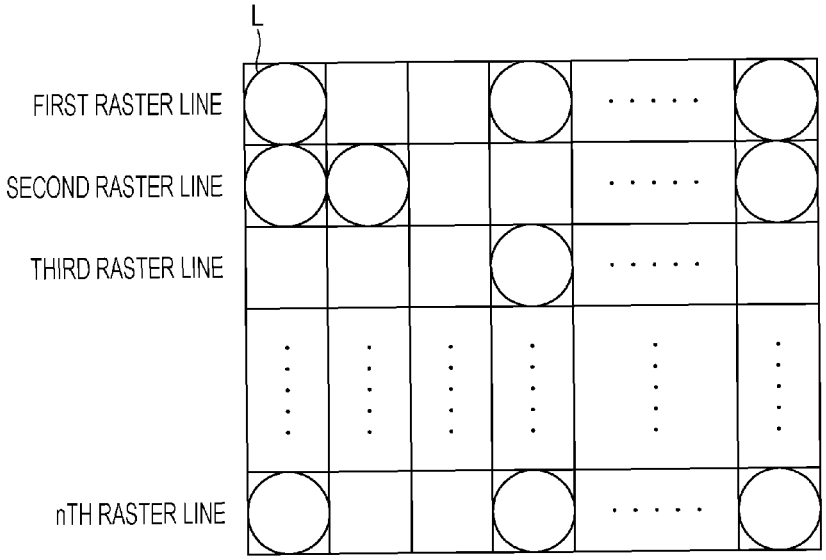
FIG. 7A is a diagram showing a second pattern of the discharge operations of a supplementary liquid and an imaging liquid according to the embodiment.
Figure 7B:
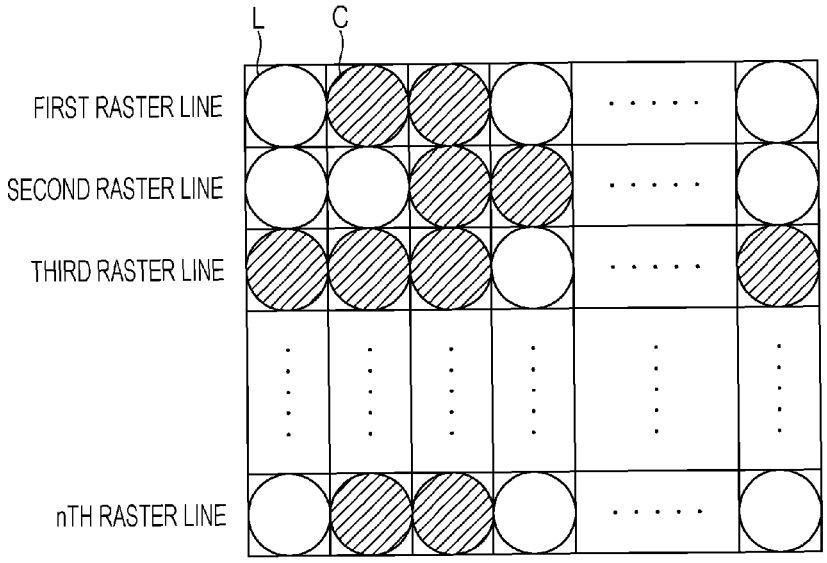
FIG. 7B is a diagram showing the second pattern of the discharge operations of the supplementary liquid and the imaging liquid according to the embodiment.
Figure 8A:
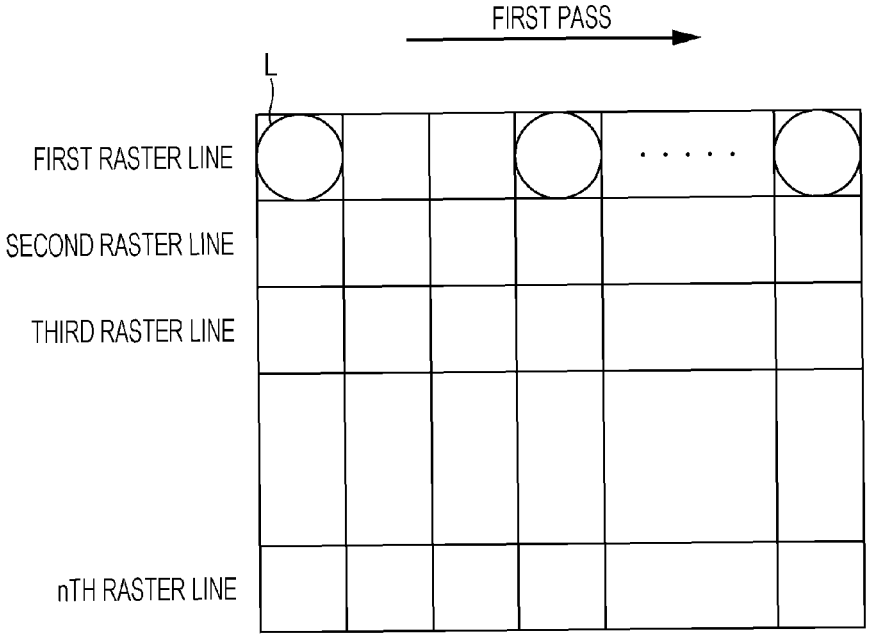
FIG. 8A is a diagram showing another example of the second pattern of the discharge operations of the supplementary liquid and the imaging liquid according to the embodiment.
Figure 8B:
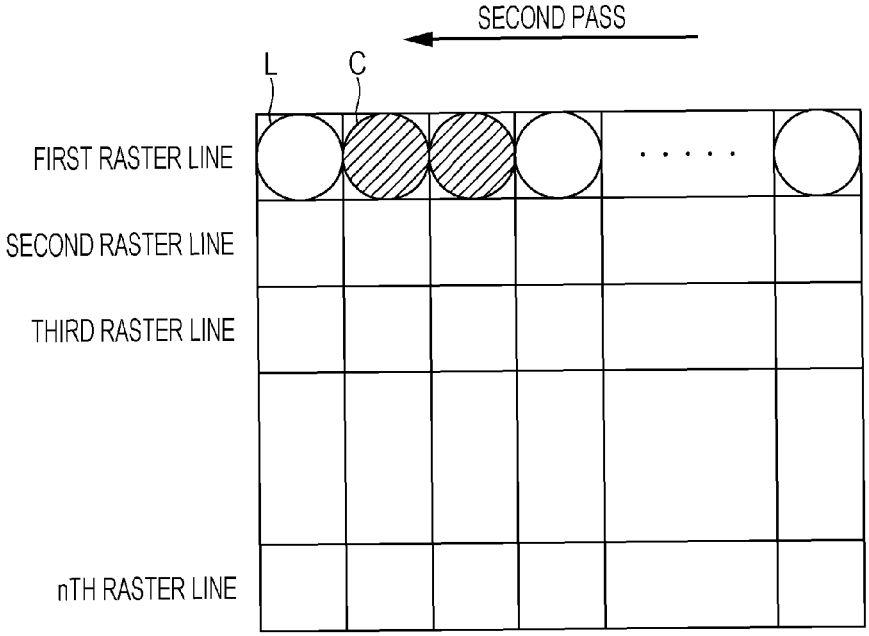
FIG. 8B is a diagram showing another example of the second pattern of the discharge operations of the supplementary liquid and the imaging liquid according to the embodiment.
Figure 8C:
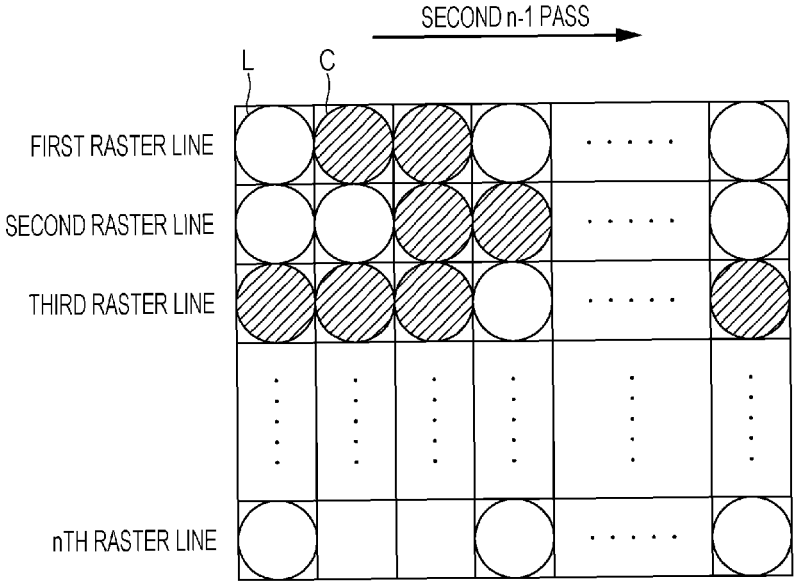
FIG. 8C is a diagram showing another example of the second pattern of the discharge operations of the supplementary liquid and the imaging liquid according to the embodiment.
Figure 8D:
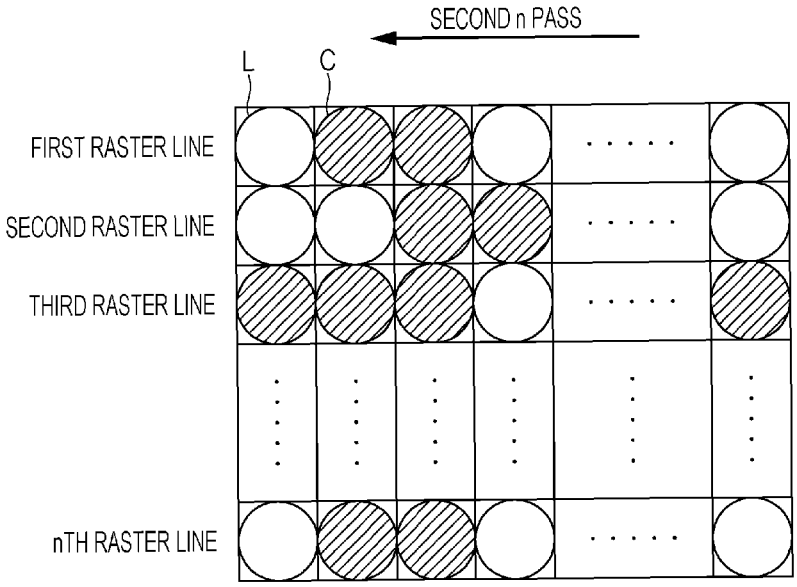
FIG. 8D is a diagram showing another example of the second pattern of the discharge operations of the supplementary liquid and the imaging liquid according to the embodiment.
Figure 9A:
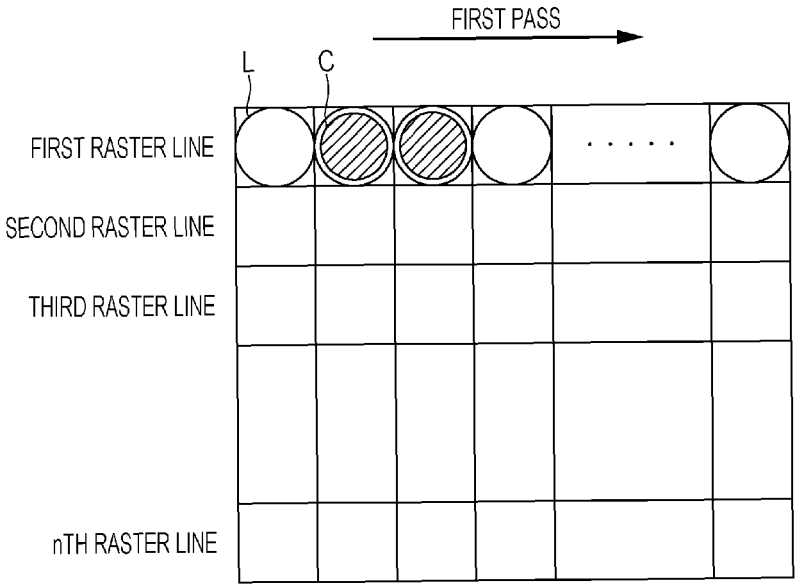
FIG. 9A is a diagram showing a third pattern of the discharge operations of a supplementary liquid and an imaging liquid according to the embodiment.
Figure 9B:
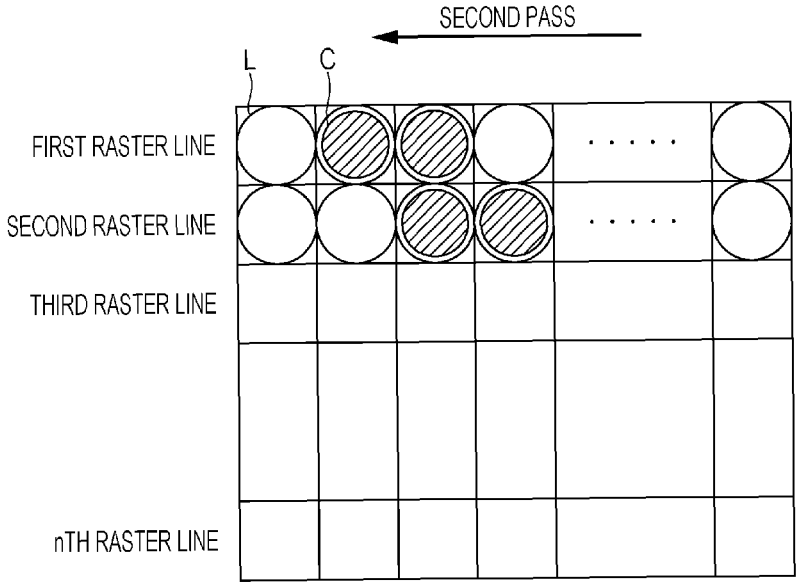
FIG. 9B is a diagram showing the third pattern of the discharge operations of the supplementary liquid and the imaging liquid according to the embodiment.
Figure 9C:
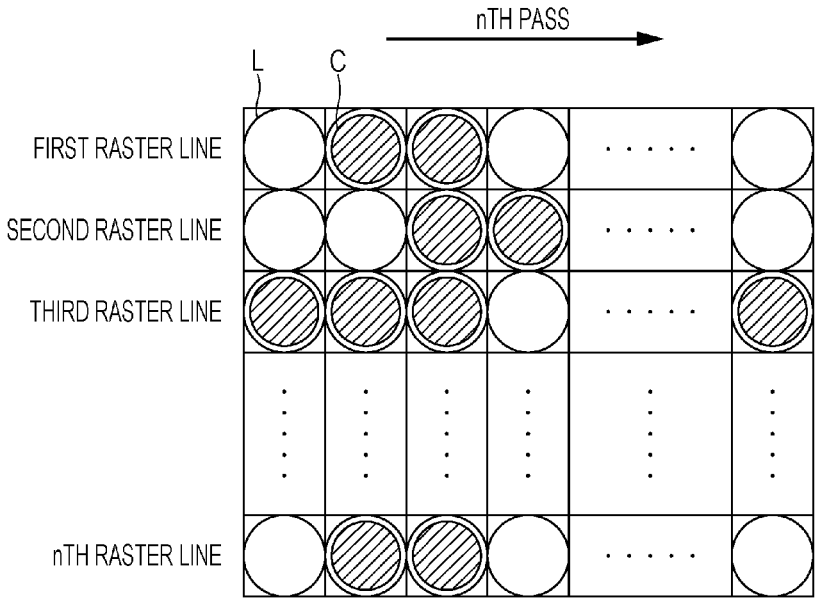
FIG. 9C is a diagram showing the third pattern of the discharge operations of the supplementary liquid and the imaging liquid according to the embodiment.
Figure 10A:
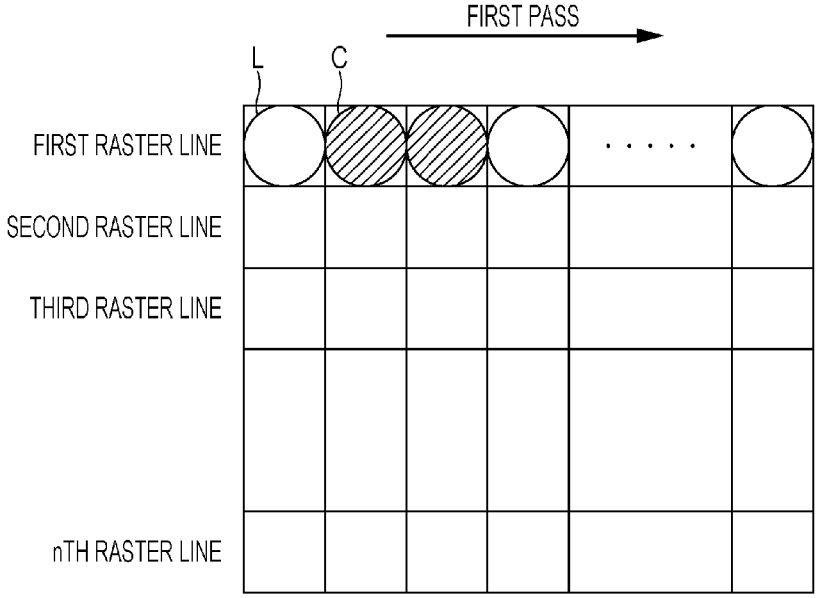
FIG. 10A is a diagram showing a fourth pattern of the discharge operations of a supplementary liquid and an imaging liquid according to the embodiment.
Figure 10B:
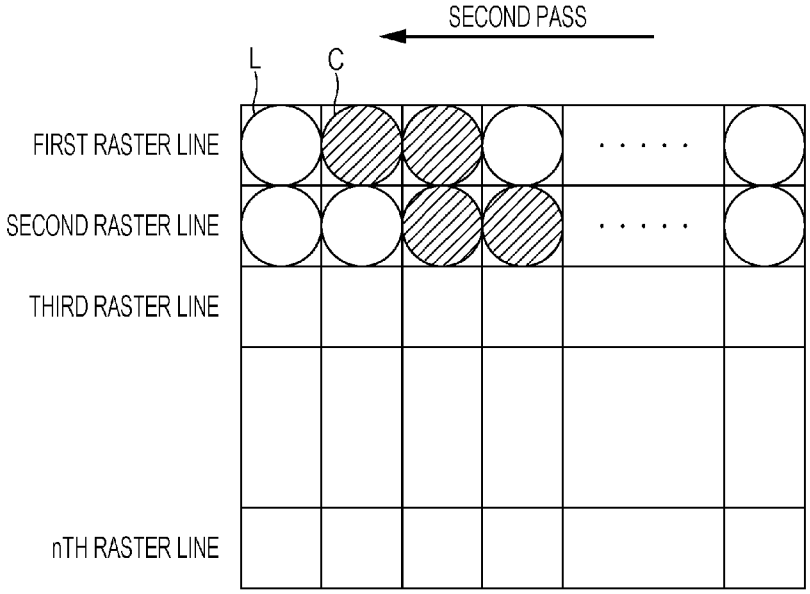
FIG. 10B is a diagram showing the fourth pattern of the discharge operations of the supplementary liquid and the imaging liquid according to the embodiment.
Figure 10C:
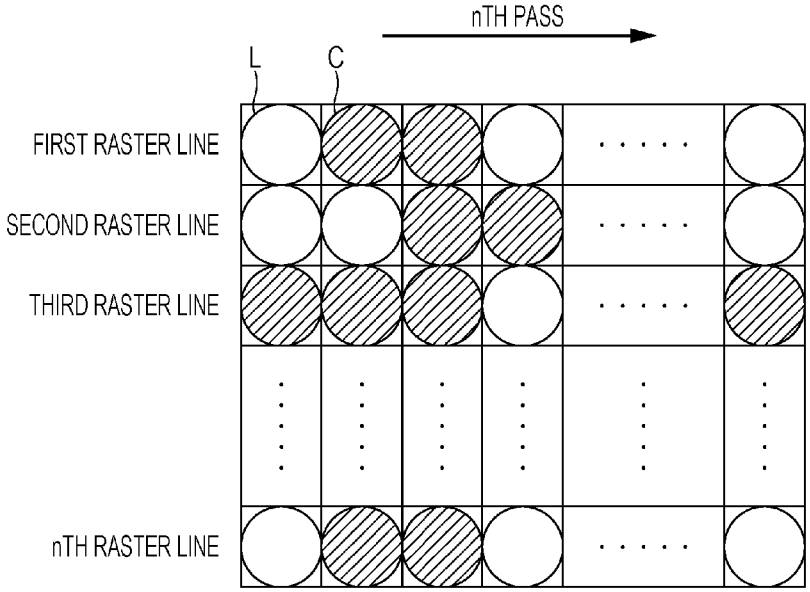
FIG. 10C is a diagram showing the fourth pattern of the discharge operations of the supplementary liquid and the imaging liquid according to the embodiment.
Figure 11:
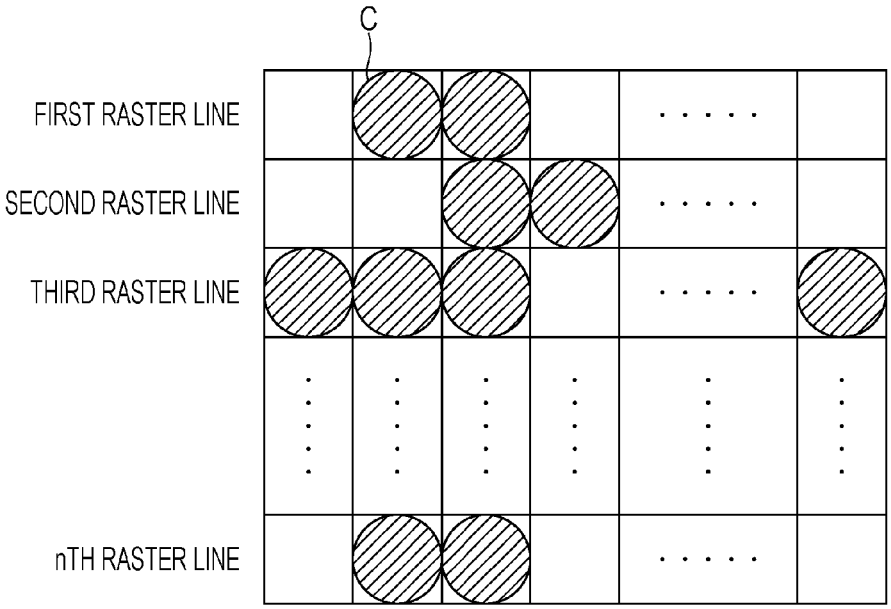
FIG. 11 is a diagram showing the discharge operations of the imaging liquid according to the embodiment.

In FIGS. 6A to 6D and 8A to 10C, description is given of an example in which the liquid is discharged in each reciprocal pass (for example, a first pass and a second pass); however, the invention is not limited thereto. For example, it is also possible to discharge the liquid in only one of the passes, such as in the first pass, the third pass . . . . In this case, it is possible to further secure the time to cause the discharged liquid to dry. Accordingly, for example, as shown in FIGS. 6A and 6B, it is possible to prevent the liquids from mixing together with one another, even when the imaging liquid C is discharged onto a region onto which the supplementary liquid L is discharged.

Discharge Operations of Liquids in Second Mode

In the second mode in this embodiment, for example, the head 21 moves from the initial position (for example, the upper left of the printing medium shown in FIG. 11) two dimensionally in relation to the printing medium, and discharges the imaging liquid C only onto the region on which the image is formed. In this case, dots of the imaging liquid C are formed on the region on which the image is formed (refer to FIG. 11). On the other hand, in the second mode, the head 21 does not perform discharging of the supplementary liquid L.

In this manner, when the second mode is selected, the ink jet printer 1 can form the image on the basis of the image data without using the supplementary liquid L.

Operation of Ink Jet Printer

Figure 12:
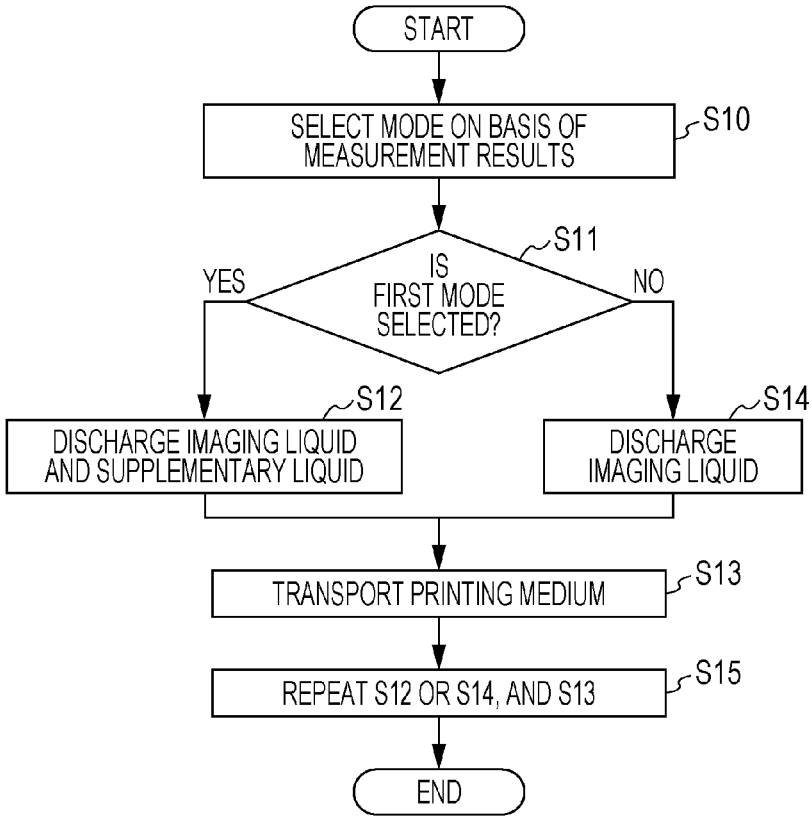
FIG. 12 is a flow chart showing the operations of the printing apparatus according to the embodiment.

Description will be given of the operation of the ink jet printer 1 in this embodiment with reference to FIG. 12. Here, description is given of an example in which the selection of the first mode and the second mode is performed automatically.

First, the controller 60 selects one of the first mode and the second mode on the basis of the measurement results of the measurement unit 70 (S10).

When the first mode is selected (when Y in S11), the controller 60 controls the head 21 to discharge the imaging liquid and the supplementary liquid onto the printing medium (S12).

When the formation of the image and the layer of the supplementary liquid on the printing medium in the printing position is completed, the controller 60 transports the printing medium to cause the region on which the image is not formed to be disposed in the printing position (S13).

When the second mode is selected (when N in S11), the controller 60 controls the head 21 to discharge the imaging liquid onto the printing medium, and to not discharge the supplementary liquid onto the printing medium (S14).

When the formation of the image on the printing medium in the printing position is completed, the controller 60 transports the printing medium to cause the region on which the image is not formed to be disposed in the printing position (S13).

The controller 60 repeats the processes S12 or S14, and S13 until the desired number of printed objects are obtained (S15).

Note that the selection of the first mode and the second mode can also be performed after the printing starts. For example, the measurement unit 70 measures the moisture of the printing medium periodically while the printing is being performed. When the controller 60 determines that the moisture is equal to or greater than a predetermined condition, it is possible to, for example, switch from the first mode to the second mode at the timing at which the printing medium is transported.

In this manner, the ink jet printer 1 in this embodiment can select a mode in which the supplementary liquid is discharged (the first mode) and a mode in which the supplementary liquid is not discharged (the second mode) in consideration of the moisture and the like in relation to a predetermined printing medium. Therefore, the variation in the amount of charge is reduced by applying the supplementary liquid, and it becomes possible to obtain a printed object with little influence of satellites. Conversely, by not using the supplementary liquid, it is also possible to save the supplementary liquid. In other words, the ink jet printer 1 in this embodiment is capable of performing printing corresponding to the demands of a user in relation to a predetermined printing medium.

Other Embodiment

The embodiments described above are intended to facilitate understanding of the invention and should not be interpreted as limiting the invention. It is needless to say that the invention may be modified and improved within a range not exceeding the spirit of the invention and furthermore, that the invention also includes equivalents thereto. In particular, even the embodiments described hereinafter are included in the invention.

The configuration of the head 21 is not limited to that shown in FIG. 3. It is sufficient for the head 21 to be configured to be capable of executing a discharge operation in the first mode and the second mode.

It is sufficient for the hot platen 41 and the drying mechanism 42 to be capable of causing the liquid (the ink) that forms the image and the layer of the supplementary liquid formed on the printing medium to dry. Therefore, for example, a configuration may also be adopted in which the printing medium is subjected to warm air, infrared rays, and electromagnetic waves such as microwaves. Alternatively, when ultraviolet (UV) curing ink is used, it is also possible to use a configuration in which the printing medium is irradiated with ultraviolet rays for the hot platen 41 and the drying mechanism 42.

For example, particularly when the moisture is low, such as in winter, there is a likelihood that it is not easy to equalize the amount of charge with the discharge amount of the supplementary liquid in the first mode. Therefore, it is also possible to provide a third mode as a mode of discharging a liquid.

The third mode is a mode in which the imaging liquid and the supplementary liquid are discharged from the head 21 onto the predetermined printing medium, and in which the discharge amount of the supplementary liquid is greater than in the first mode. For the discharge operation of the liquids in the third mode, it is possible to execute the same operation as in the first mode. It is possible to perform the selection of the third mode automatically or manually.

In the case of automatic selection, for example, the controller 60 compares the value (%) of moisture that is measured by the measurement unit 70 with a condition that is set in advance (for example, first mode: a moisture of 20% or higher and 49% or lower, second mode: 50% or higher, third mode: 19% or lower). For example, when the measured moisture is 10%, the controller 60 selects and executes the third mode. The third mode is stored in the memory 63 or the like in a state of being associated with the predetermined printing medium.

On the other hand, in the case of manual selection, for example, the operator of the ink jet printer 1, confirms the value indicated by an indoor hygrometer. When the value indicated by the hygrometer is particularly low (for example, 10% moisture), the operator can determine that there is an extremely high likelihood that a charge will be generated on the printing medium. In this case, the operator selects the third mode, which is set in advance, via the input unit (not shown) or the like of the ink jet printer 1. The controller 60 executes the selected third mode.

It is also conceivable to increase the discharge amount of the supplementary liquid even when the first mode is selected, instead of providing the third mode.

In this case, for example, the controller 60 compares the measurement result from the measurement unit 70 and a predetermined threshold value. The predetermined threshold value is a value (for example, a value based on a moisture of 19% or less) for determining whether or not to cause the amount of the supplementary liquid that is discharged to be increased.

When the moisture measured by the measurement unit 70 is a predetermined threshold value or less, the controller 60 controls the head 21 to increase the discharge amount of the supplementary liquid. A predetermined value is set in advance for the increase amount of the supplementary liquid.

When selecting the first mode to the third mode, conditions other than the moisture may be considered. For example, depending on the type or the demanded image quality of the image to be printed, there may also be a case in which the influence of satellites may not be considered. Alternatively, in general, since clear ink costs more than colored ink, when the overall cost of printing is considered, there may also be a case in which the clear ink is not used. In such a case, for example, the operator may set the second mode via the input unit (not shown) of the ink jet printer 1. The controller 60 executes the set second mode.

Figure 13:
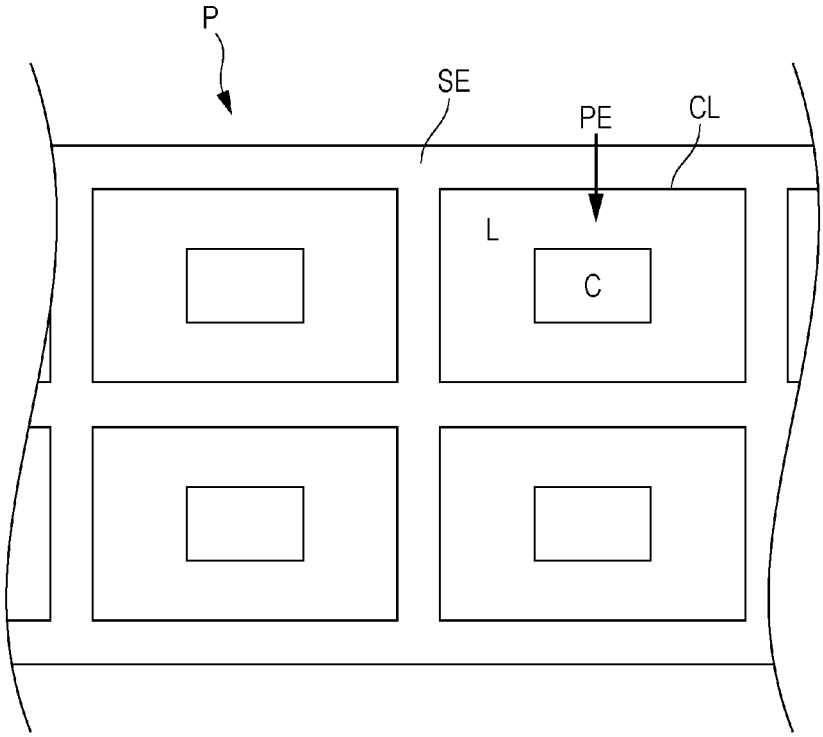
FIG. 13 is a diagram showing a printed object according to another embodiment.

FIG. 13 is a schematic diagram showing an example of a printed object P that is printed by the ink jet printer 1. As shown in FIG. 13, depending on the printed object P, there is a case in which a printing region PE, and a region SE, which is peeled off after the image is formed, are formed in a region of the printing medium.

Therefore, when the peel-off region SE is present, and the first mode is selected, the controller 60 controls the head 21 to not execute the discharging of the supplementary liquid onto the peel-off region SE. Specifically, the controller 60 sets the printing region PE in relation to the printing medium in the printing position in advance on the basis of the image data or the like that indicates the size of the printing medium, the number of images to print, and the image to print. The controller 60 performs the same processes as in the embodiment, and performs printing in relation to the printing region PE in the first mode or the second mode.

On the other hand, when a region other than the set printing region PE is present on the printing medium in the printing position, the controller 60 determines the region to be the peel-off region SE. The controller 60 controls the head 21 to not discharge the supplementary liquid onto the peel-off region SE. Note that, the boundary between the printing region PE and the peel-off region SE is referred to as the "cut line CL". It is possible to determine the cut line CL on the basis of the image data or the like.

As described above, it is possible to reduce the influence of satellites by equalizing the distribution of the amount of charge. However, in actuality, the distribution of the satellites has merely become uniform together with the equalization of the distribution of the amount of charge, and the satellites accumulate on the printing region. Therefore, the supplementary liquid is not discharged onto the peel-off region SE, and by actually leaving a portion on which the distribution of the amount of charge is uneven, it is possible to selectively cause the satellites to accumulate on the portion (the peel-off region SE). Accordingly, it is possible to further reduce the influence of satellites in the printing region PE.

The imaging liquid and the supplementary liquid may be aqueous inks, or may be oil-based inks.

The liquid is not limited to being an ink, and it is also possible to use a liquid other than ink (including, in addition to a liquid, a liquid body in which particles of a functional material are dispersed, and a fluid body such as a gel), and fluid bodies other than liquids (including solids that can flow as fluids and can be discharged).

It is also possible to apply the configuration of the embodiment described above to a line printer, or a serial scanning system ink jet printer. The serial scanning system is a system in which the image is formed by repeatedly performing the discharging of the liquid and the transportation of the printing medium. In other words, when performing formation of the image using the serial system, at the point in time at which the printing medium is transported, an image that is based on the image data is not yet completed. A Large Format Printer (LFP) is an example of the serial scanning system ink jet printer.

The entire disclosure of Japanese Patent Application No. 2013-065797, filed Mar. 27, 2013 is expressly incorporated by reference herein.

What is claimed is:

1. A printing apparatus, comprising:

a head which discharges an imaging liquid for forming an image, and a supplementary liquid for supplementing formation of the image with the imaging liquid on a predetermined printing medium; and a control unit which is capable of selectively executing a first mode, in which the imaging liquid and the supplementary liquid are discharged from the head onto the predetermined printing medium, and a second mode, in which the imaging liquid is discharged from the head, and the supplementary liquid is not discharged from the head, wherein the first mode or the second mode is selected based on an environmental condition of the printing medium.

2. The printing apparatus according to claim 1, wherein the control unit is capable of selectively executing a third mode, which is a mode in which the imaging liquid and the supplementary liquid are discharged from the head onto the predetermined printing medium, and in which the discharge amount of the supplementary liquid is greater than in the first mode.

3. The printing apparatus according to claim 1, further comprising:

a measurement unit which measures a moisture of the printing medium, wherein, when a measurement result obtained by the measurement unit is a predetermined threshold value or less, the control unit controls the head to increase the discharge amount of the supplementary liquid in the first mode.

4. The printing apparatus according to claim 1, wherein, when the first mode is selected, the control unit controls the head to execute the discharge of the imaging liquid and the discharge of the supplementary liquid in different passes.

5. The printing apparatus according to claim 1, wherein, when the first mode is selected, the control unit controls the head to execute the discharge of the imaging liquid and the discharge of the supplementary liquid in a same pass.

6. The printing apparatus according to claim 1, wherein, when the first mode is selected, the control unit controls the head to execute the discharge of the supplementary liquid in relation to a region of the printing medium that contains a region on which the image is formed.

7. The printing apparatus according to claim 1, wherein, when the first mode is selected, the control unit controls the head to execute the discharge of the supplementary liquid in relation to a region of the printing medium onto which the imaging liquid is not discharged.

8. The printing apparatus according to claim 1, wherein, when a region, which is peeled off after the image is formed, is present in a region of the printing medium, and the first mode is selected, the control unit controls the head to not execute the discharge of the supplementary liquid in relation to the peel-off region.

9. The printing apparatus according to claim 1, wherein the environmental condition is one of an amount of charge of the printing medium or an amount of moisture of the printing medium.

* * * * *